US011390485B2

(12) United States Patent
Hoover

(10) Patent No.: US 11,390,485 B2
(45) Date of Patent: Jul. 19, 2022

(54) YARN TENSIONER, TEXTILE MACHINE, AND METHOD FOR TENSIONING A CONTINUOUSLY RUNNING YARN

(71) Applicant: American Line, LLC, Gastonia, NC (US)

(72) Inventor: Donald Lynn Hoover, Cramerton, NC (US)

(73) Assignee: American Line, LLC, Gastonia, NC (US)

( * ) Notice: Subject to any disclaimer, the term of this patent is extended or adjusted under 35 U.S.C. 154(b) by 0 days.

(21) Appl. No.: 17/255,287

(22) PCT Filed: Jun. 24, 2019

(86) PCT No.: PCT/US2019/038704
§ 371 (c)(1),
(2) Date: Dec. 22, 2020

(87) PCT Pub. No.: WO2019/246614
PCT Pub. Date: Dec. 26, 2019

(65) Prior Publication Data

US 2021/0163254 A1 Jun. 3, 2021

Related U.S. Application Data

(60) Provisional application No. 62/688,774, filed on Jun. 22, 2018.

(51) Int. Cl.
*B65H 59/28* (2006.01)
*B65H 59/06* (2006.01)

(52) U.S. Cl.
CPC ..... *B65H 59/28* (2013.01); *B65H 59/06* (2013.01); *B65H 2701/31* (2013.01)

(58) Field of Classification Search
CPC ..... B65H 59/06; B65H 59/28; B65H 2701/31
See application file for complete search history.

(56) References Cited

U.S. PATENT DOCUMENTS

| | | | |
|---|---|---|---|
| 2,964,259 | A | 12/1960 | Peel |
| 3,087,689 | A | 4/1963 | Heim |
| 2011/0114780 | A1 | 5/2011 | Hoover |

FOREIGN PATENT DOCUMENTS

| | | |
|---|---|---|
| GB | 632312 | 11/1949 |

*Primary Examiner* — William E Dondero
(74) *Attorney, Agent, or Firm* — Schwartz Law Firm, P.C.

(57) ABSTRACT

A yarn tensioner is adapted for adjusting tension in a running yarn. The yarn tensioner has a base, an adjustable pin rack, a fixed pin rack, and a fastener assembly. The adjustable pin rack is carried by the base and incorporates a first plurality of spaced apart parallel friction pins. The fixed pin rack is carried by the base and incorporates a second plurality of spaced apart parallel friction pins residing alternately between the friction pins of the adjustable pin rack. The running yarn travels across the yarn tensioner by snaking over and under adjacent parallel friction pins of the adjustable pin rack and the fixed pin rack. The fastener assembly attaches the adjustable pin rack to the base, such that the adjustable pin rack is movable relative to the fixed pin rack, thereby controlling frictional drag on the running yarn.

18 Claims, 19 Drawing Sheets

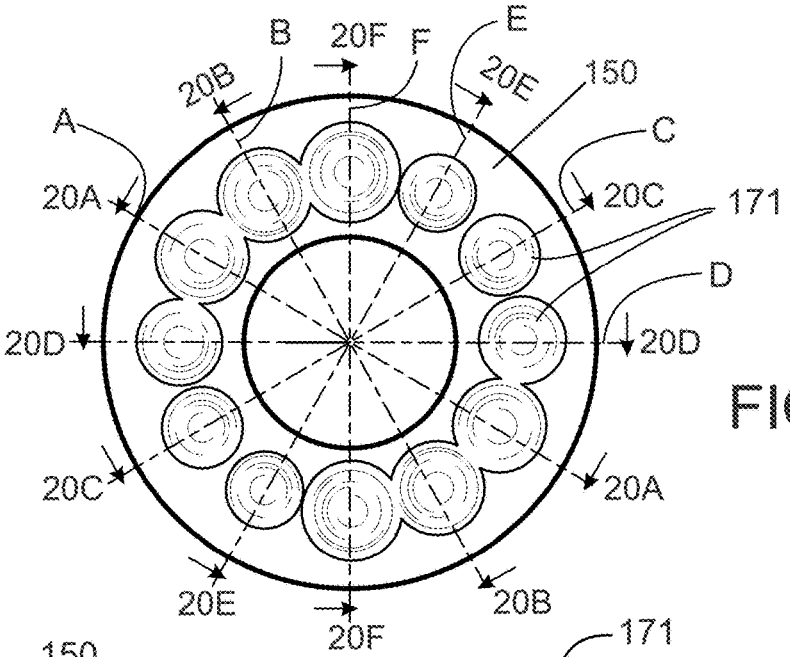
FIG. 19
FIG. 20A
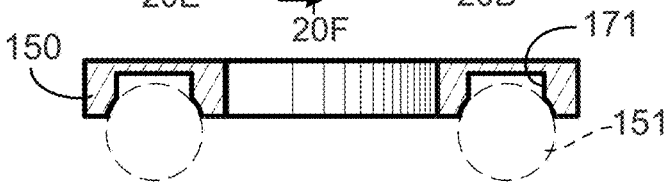
FIG. 20B
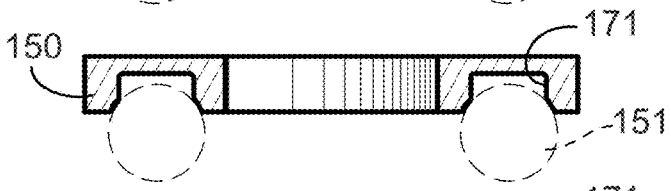
FIG. 20C
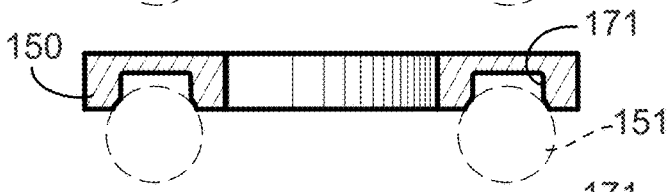
FIG. 20D
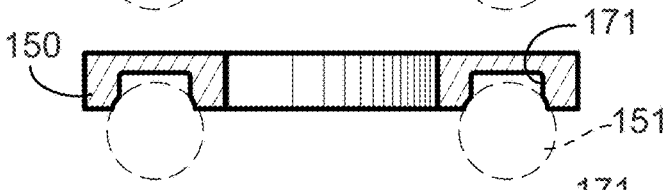
FIG. 20E
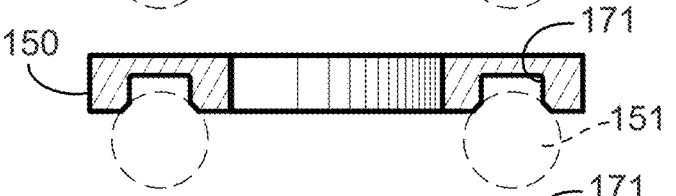
FIG. 20F
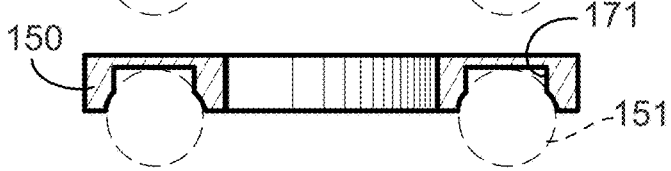

YARN TENSIONER, TEXTILE MACHINE, AND METHOD FOR TENSIONING A CONTINUOUSLY RUNNING YARN

The present disclosure relates broadly and generally to the textile industry, and more particularly to a yarn tensioner, textile machine, and method for tensioning a continuously running yarn. In one exemplary embodiment, the pre-tensioner of the present disclosure is utilized in combination with a cannister- (or pot-)yarn tensioning device in a direct-cabling textile machine. One exemplary tensioning device is described in Applicant's prior published international (PCT) patent application, Publication No. WO 2017/027257 and U.S. Application Pub. 2018/0273338-A1. The complete disclosure of this reference is incorporated herein by reference.

TECHNICAL FIELD AND BACKGROUND

Summary of Exemplary Embodiments

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a yarn tensioner (e.g., pre-tensioner) adapted for adjusting tension in a running yarn. The yarn tensioner has a base, an adjustable pin rack, a fixed pin rack, and a fastener assembly. The term "adjustable" refers broadly herein to any movability of the adjustable pin rack relative to the fixed pin rack including, but not limited to, pivoting movement and/or planar movement. The adjustable pin rack is carried by the base and incorporates a first plurality of spaced apart parallel friction pins. The fixed pin rack is carried by the base and incorporates a second plurality of spaced apart parallel friction pins residing alternately between the friction pins of the adjustable pin rack. The running yarn travels across the yarn tensioner by snaking over and under adjacent parallel friction pins of the adjustable pin rack and the fixed pin rack. The fastener assembly attaches the adjustable pin rack to the base, such that the adjustable pin rack is movable relative to the fixed pin rack, thereby controlling frictional drag on the running yarn.

The adjustable pin rack is moveable relative to the fixed pin rack. The term "moveable" is used broadly to refer to any pivoting and/or planar movement of the adjustable pin rack relative to the fixed pin rack. The fixed pin rack may be separately formed in a structural manner similar to the adjustable pin rack, or may be integrally formed with the base (e.g., as spaced ridges) and as a single homogenous unit.

According to another exemplary embodiment, the adjustable pin rack has opposing distal and proximal ends, and a lift tab located at the distal end adjacent a rounded nose of the fixed pin rack.

According to another exemplary embodiment, a pivot block is located at the proximal end of the adjustable pin rack.

According to another exemplary embodiment, the pivot block and the base define substantially aligned block and base openings. The fastener assembly comprises an upper spring housing adjacent the block opening, a coiled spring located within the upper spring housing, an interior spacer sleeve extending within the spring, and an assembly bolt. The assembly bolt extends through the spacer sleeve, the block opening, and the base opening. The assembly bolt cooperates with the spring to maintain the adjustable pin rack in a spring-biased condition adjacent the base.

According to another exemplary embodiment, the block opening is larger than the base opening, such that the adjustable pin rack is capable of upward pivoting movement from the spring-biased condition adjacent the base.

According to another exemplary embodiment, the base comprises a notched base extension and a base plate adjacent the base extension. The assembly bolt attaches the pivot block to the base plate such that upward and downward planar movement of the base plate relative to the base extension effects corresponding upward and downward planar movement of the adjustable pin rack relative to the fixed pin rack.

The term "planar movement" (and "planar adjustment") refers herein to upward and downward vertical movement of the adjustable pin rack in a substantially horizontal condition (or 0-degree angle) relative to the fixed pin rack. The term "horizontal" is used herein to refer to a direction, orientation or movement which is generally parallel to the plane of the fixed pin rack. The term "vertical" is used herein to refer to a direction, orientation or movement which is generally perpendicular to the plane of the fixed pin rack. The terms "upward" and "downward" refer to vertical movement relative to the plane of the fixed pin rack.

According to another exemplary embodiment, a rotatable tension adjustment wheel resides between the base plate and a top bearing surface of the base extension.

According to another exemplary embodiment, at least one ball bearing resides between the tension adjustment wheel and the top bearing surface of the base extension.

According to another exemplary embodiment, an underside of the tension adjustment wheel defines a plurality of circumferentially arranged annular bearing races.

According to another exemplary embodiment, a second assembly bolt extends through aligned openings formed in the base plate, the tension adjustment wheel, and the base extension.

According to another exemplary embodiment, a barrel spacer surrounds the second assembly bolt.

According to another exemplary embodiment, a lower spring housing resides adjacent a bottom side of the base extension. A coiled spring is located within the lower spring housing and cooperates with the second assembly bolt to maintain the tension adjustment wheel in a spring-biased condition relative to the at least one ball bearing and the bearing surface of the base extension.

According to another exemplary embodiment, adjacent ones of the bearing races are formed at different depths, such that rotation of the tension adjustment wheel locates the ball bearing in a selected bearing race of a particular depth. Locating the ball bearing in one of the relatively deep bearing races moves the adjustable pin rack to an adjusted downward location relative to the fixed pin rack, thereby increasing tension in the running yarn traveling across the yarn tensioner. Locating the ball bearing in one of the relatively shallow bearing races moves the adjustable pin rack to a raised position relative to the fixed pin rack, thereby reducing tension in the running yarn traveling across the yarn tensioner.

According to another exemplary embodiment, the tension adjustment wheel includes tension setting indicia.

In another exemplary embodiment, the present disclosure comprises a yarn supply canister for use in a direct-cabling textile machine. The supply canister incorporates a canister housing designed for holding a yarn supply package upstream of the textile machine. A yarn guide is located inside the canister housing for receiving running yarn pulled from the supply package at an unwinding tension. A yarn tensioner is located downstream of the yarn guide for adjusting unwinding tension in the running such that the yarn exits the canister housing at an adjusted delivery tension. The exemplary yarn supply canister incorporates embodiments of the yarn tensioner disclosed herein.

In yet another exemplary embodiment, the present disclosure comprises a method for adjusting tension in a running yarn. The method includes drawing the running yarn alternatively over and under adjacent parallel friction pins of an adjustable pin rack and a fixed pin rack. The method enables pivoting movement of the adjustable pin rack relative to the fixed pin rack, such that a distal end of the adjustable pin rack is capable of lifting upwardly at a rounded nose of the fixed pin rack. The method further enables planar upward and downward adjustment of the adjustable pin rack relative to the fixed pin rack, such that:

a lowered position of the adjustable pin rack relative to the fixed pin rack increases tension in the running yarn; and a raised position of the adjustable pin rack relative to the fixed pin rack reduces tension in the running yarn.

Use of the terms "upstream" and "downstream" refer herein to relative locations (or movement) of elements or structure to other elements or structure along or adjacent the path of yarn travel. In other words, a first element or structure which is encountered along or adjacent the path of yarn travel before a second element or structure is considered to be "upstream" of the second element or structure, and the second element structure is considered to be "downstream" of the first.

The term "closely spaced" means sufficiently spaced apart to allow snaking passage of yarn between adjacent pins of the adjustable pin rack and the fixed pin rack. One or more yarn-contacting surfaces of the exemplary tensioner may comprise a material coating, such as ceramic and plasma. Additionally, the friction pins may be fabricated of an anodized aluminum, solid ceramic, or other suitable material.

The term "sequentially spaced" is defined herein to mean the physical and/or temporal spacing of elements or structure downstream along or adjacent the path of yarn travel.

The term "housing" refers broadly herein to any open, closed, or partially open or partially closed structure.

BRIEF DESCRIPTION OF THE DRAWINGS

The description of exemplary embodiments proceeds in conjunction with the following drawings, in which:

FIGS. 17, 18 and 19 are views showing an underside of the exemplary tension adjustment wheel;

FIGS. 20A-20F are cross-sectional views of the exemplary tension adjustment wheel with the 2 ball bearings seated in respective bearing races and shown in broken lines;

DESCRIPTION OF EXEMPLARY EMBODIMENTS AND BEST MODE

Figure 1:
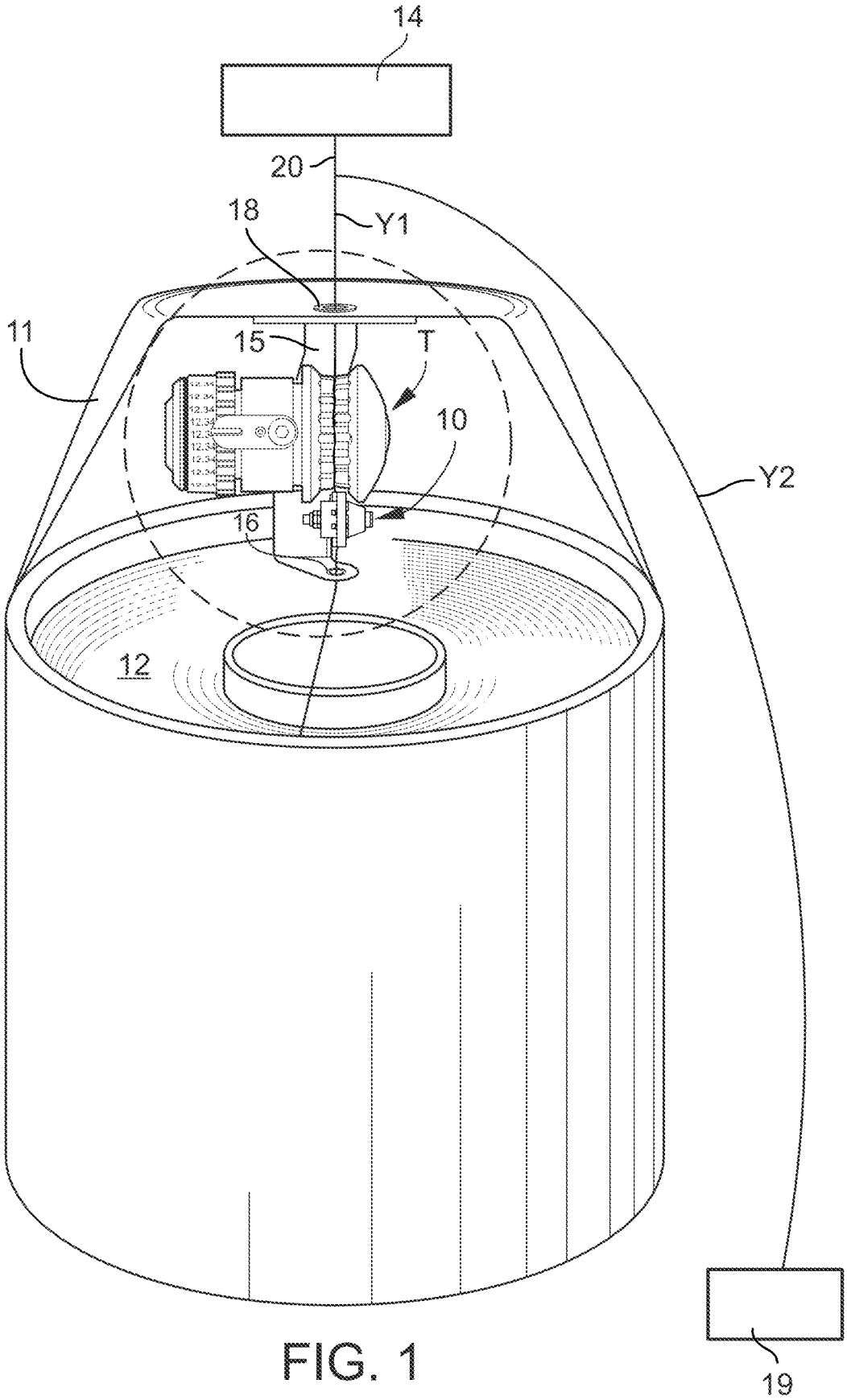
FIG. 1 is an environmental view of an exemplary yarn tensioner ("pre-tensioner") located inside a supply canister between an upstream yarn feed package and a downstream textile machine.
Figure 2:
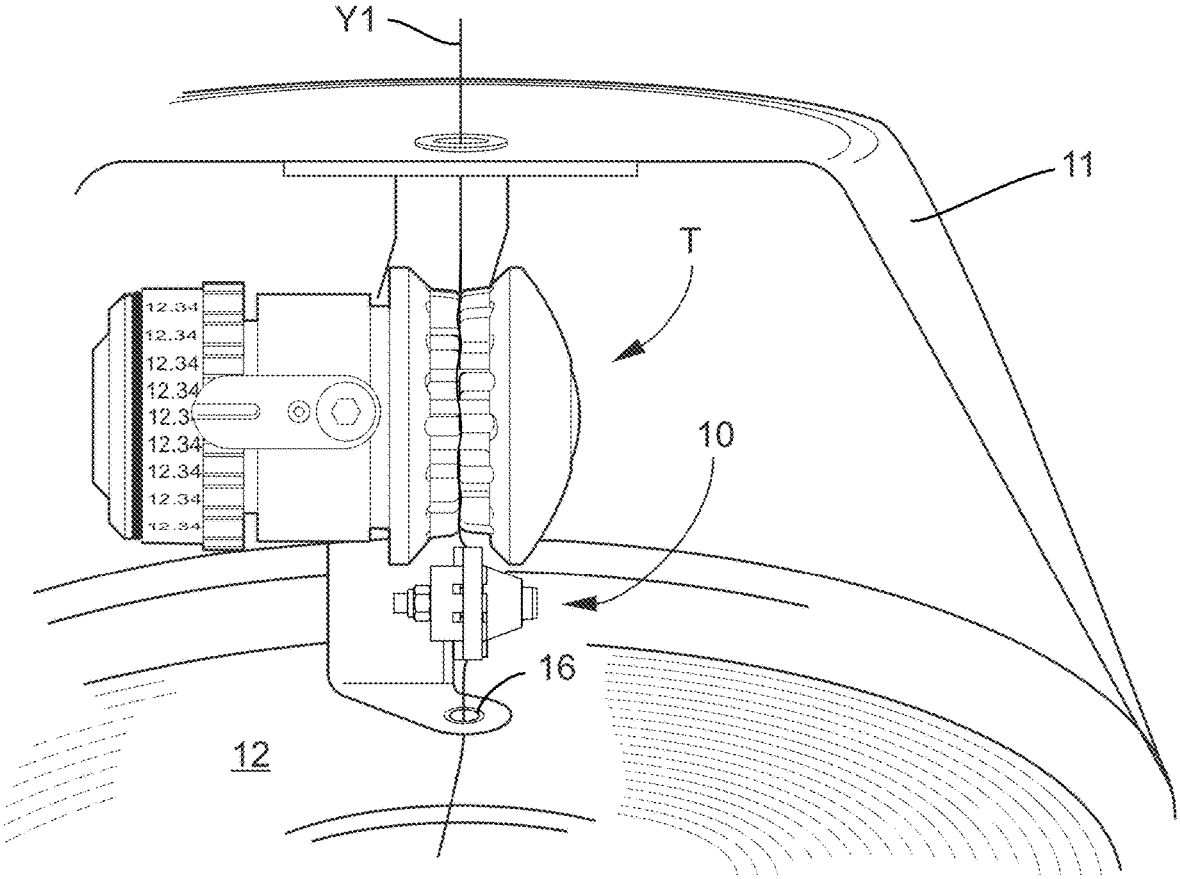
FIG. 2 is an enlarged view of the area designated at reference numeral 2 in FIG. 1.
Figure 3:
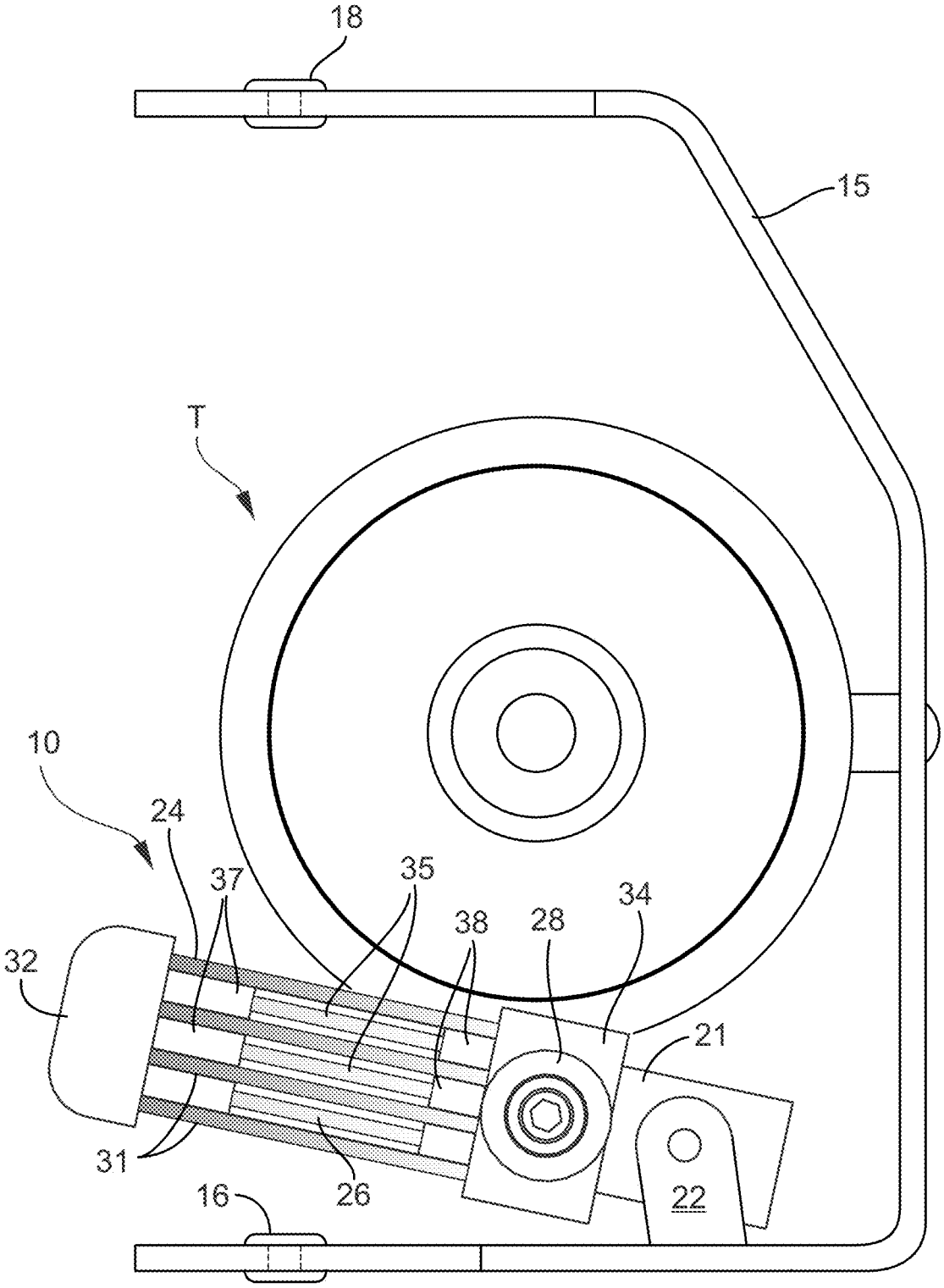
FIG. 3 is a further enlarged view of the exemplary yarn tensioner mounted inside the supply canister.
Figure 4:
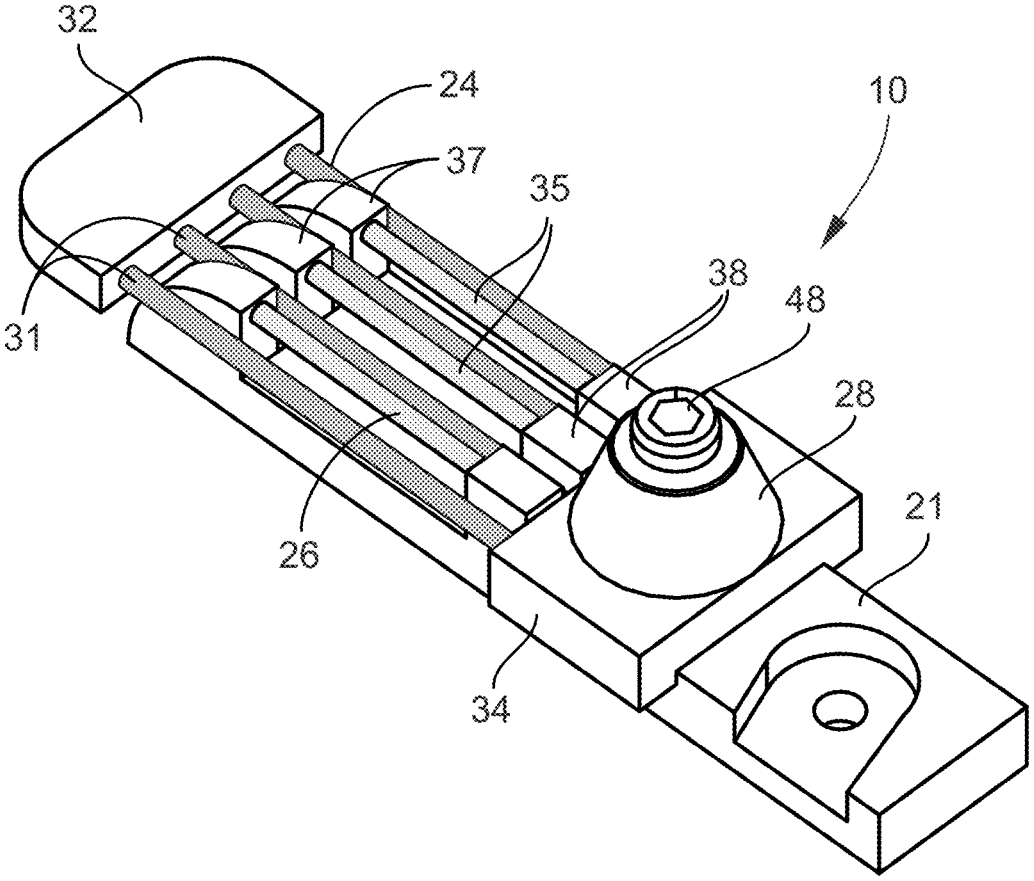
FIG. 4 is a perspective view of the exemplary yarn tensioner.

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Referring now specifically to the drawings, an adjustable yarn tensioner according to one exemplary embodiment of the present invention is illustrated in FIGS. 1-4, and shown generally at reference numeral 10. The exemplary yarn tensioner 10 is located inside a supply canister 11 between an upstream yarn feed package 12 (e.g., single ply filament) and a downstream textile machine—indicated diagrammatically at 14. The exemplary yarn tensioner 10 (also referred to as a "pre-tensioner") may be used in combination with a second yarn tensioner "T" such as that described in Applicant's prior published international (PCT) patent application, Publication No. WO 2017/027257 and U.S. Application Pub. 2018/0273338-A1. The complete disclosure of this reference is incorporated herein by reference. The textile machine 14 may be a conventional direct-cabling machine used to form high-quality pile in the manufacture of rugs and carpets. In other applications, exemplary yarn tensioners of the present disclosure may also be used in the creel on the cabler, in other types of creels, and in other various textile machines and processes. One alternative exemplary yarn tensioner 100 is shown in FIGS. 10-13 and described further below.

In a direct-cabling machine, the feed package 12 is loaded into the cannister 11 and the yarn Y1 unwound and tensioned using a tensioning device or "yarn brake", such as the tensioner "T" disclosed in Publication No. WO 2017/027257 and U.S. Application Pub. 2018/0273338-A1. The tensioner "T" may be suspended above the package 12 inside the canister 11 by mounting bracket 15 or other suitable structure. The mounting bracket 15 has a yarn guide 16. The present pre-tensioner 10 is carried by the mounting bracket 15 upstream of the yarn tensioner "T", and functions to tension the running yarn immediately prior to its passage to the second tensioner "T". An annular guide 18 is located at a top wall of the cannister 11 downstream of the second tensioner "T".

Figure 10:
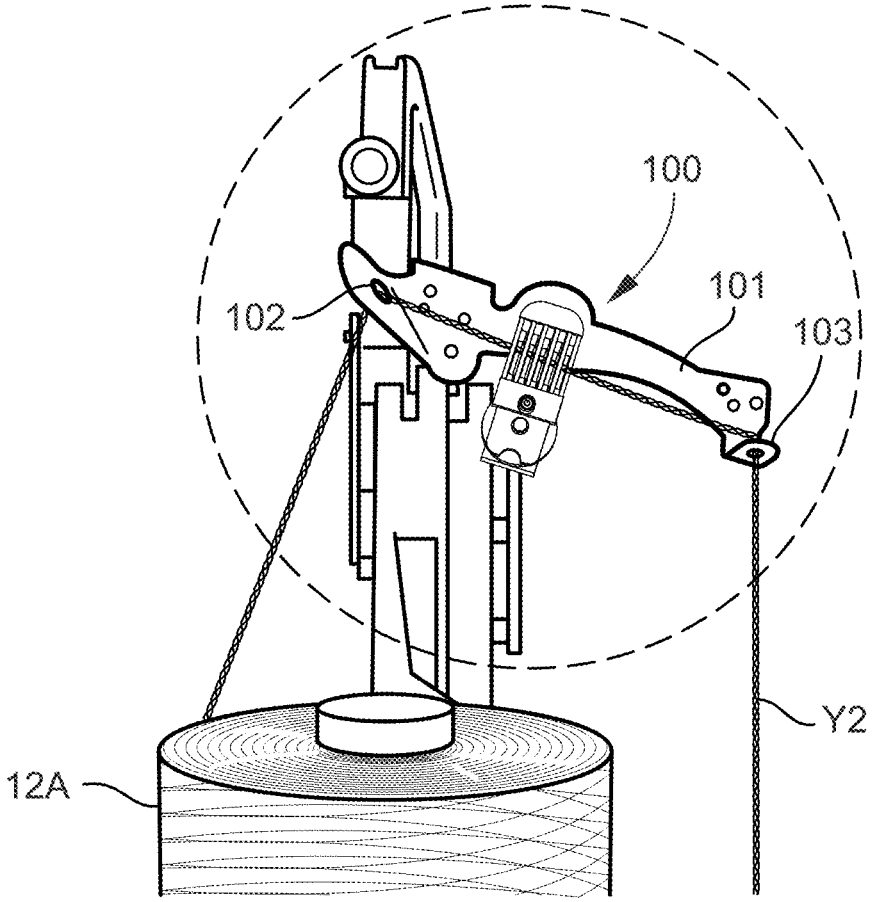
FIG. 10 is an environmental view of an exemplary yarn tensioner mounted at the creel outside of the supply canister.
Figure 11:
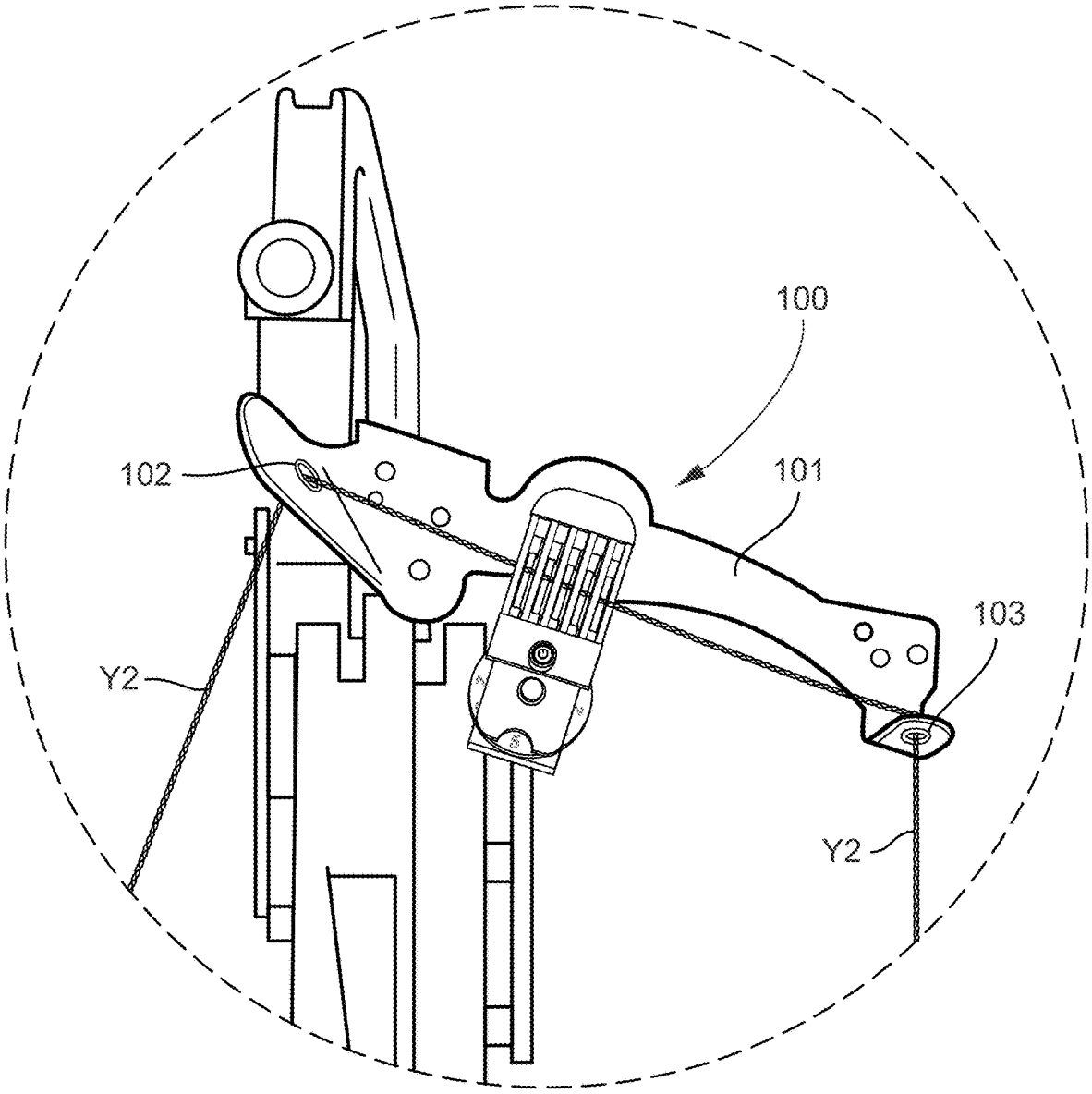
FIG. 11 is an enlarged view of the area designated at reference numeral 11 in FIG. 10.
Figure 12:
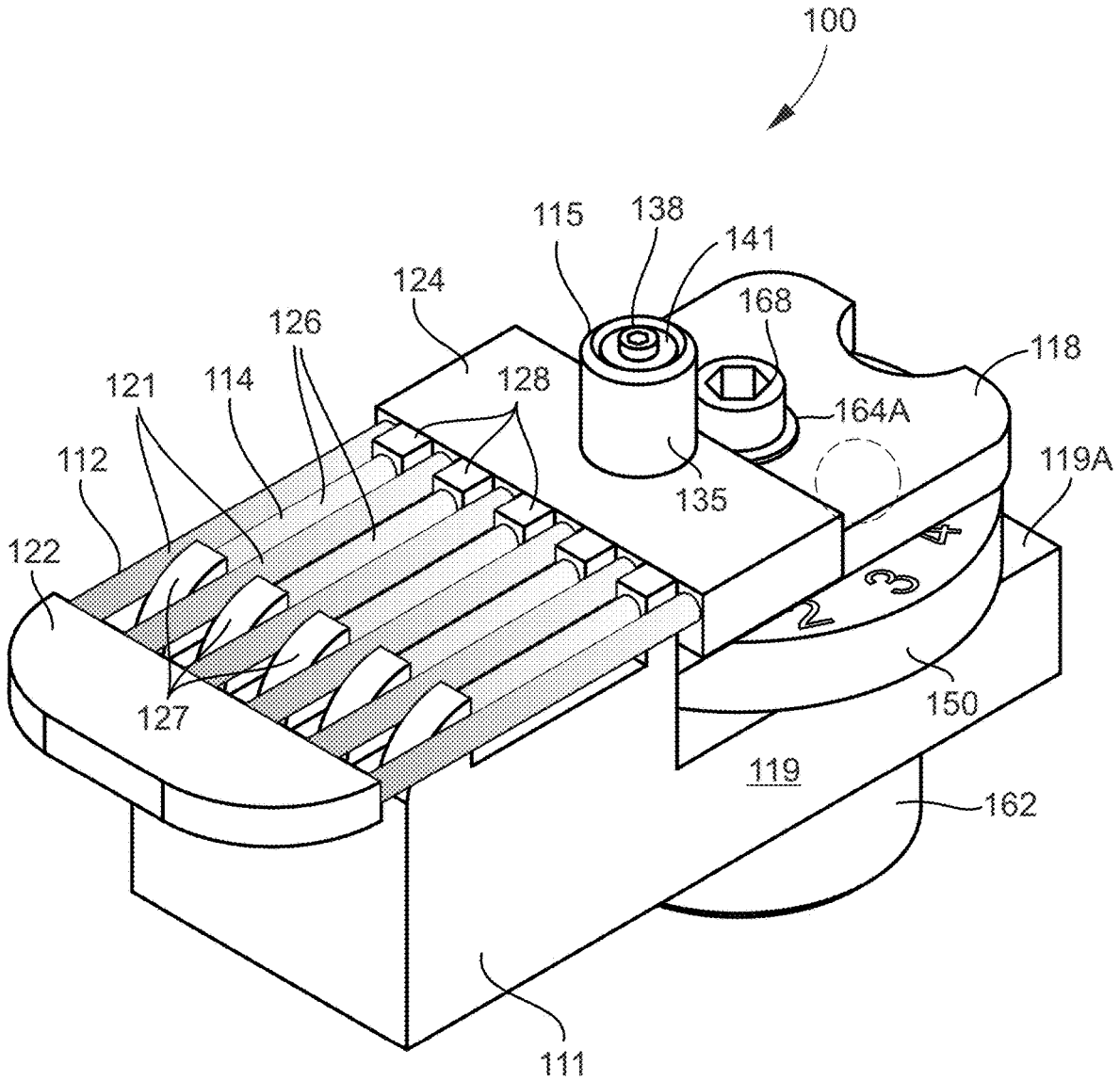
FIGS. 12 and 13 are perspective views of the exemplary yarn tensioner.
Figure 13:
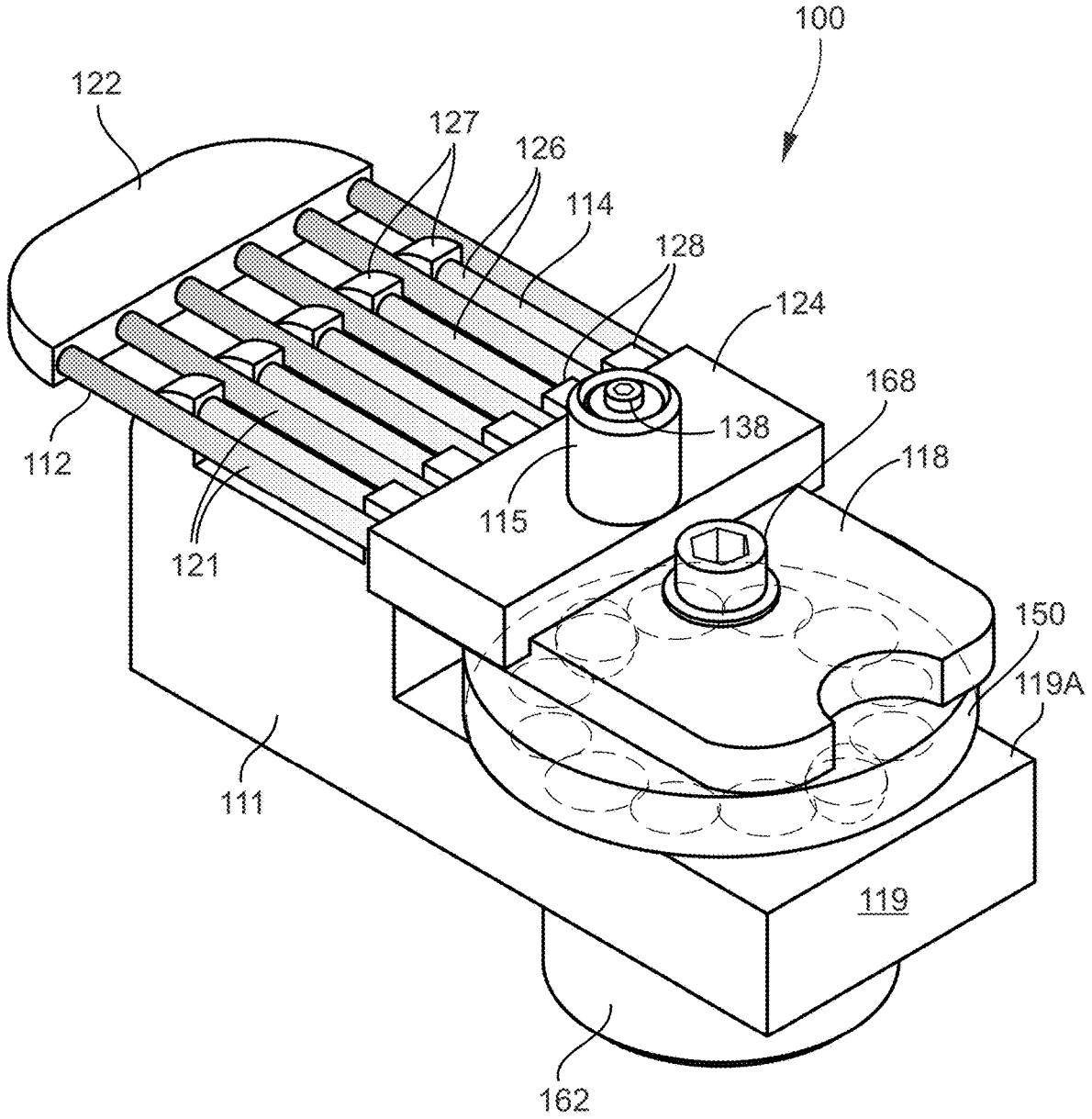

A second feed package 12A is loaded into a creel, unwound, and slightly tensioned utilizing the yarn tensioner 100, shown in FIGS. 10 and 11, before it enters a lower hollow shaft of a spindle. This yarn end Y2 wraps around a storage disc 19 and forms a balloon around the cannister 11. At the balloon apex outside of guide 18, both yarns Y1, Y2 meet and wrap around each other, which thus dissolves the false twist in the balloon yarn Y2. At the meeting point 20, both yarns Y1, Y2 should have substantially the same tension in order to form a balanced composite yarn with no or limited residual torque and substantially equal lengths of component yarns. Consequently, whenever the spindle speed is altered, tension in the cannister yarn Y1 is adjusted by the exemplary pre-tensioner 10 and yarn tensioner "T" to compensate for a consequent increase or decrease in tension of the balloon yarn Y2.

As yarn is pulled from the feed package 12 and fed through pre-tensioner 10, the yarn tensioner "T" interposed between the package 12 and downstream textile machine 14 applies predetermined (e.g., calibrated) frictional resistance to the running yarn Y1, such that the delivery tension is maintained at a generally uniform, constant and predictable level. This process is described and illustrated in detail in Applicant's Publication No. WO 2017/027257 and U.S. Application Pub. 2018/0273338-A1.

Exemplary Yarn Tensioner 10

Referring to FIGS. 3-9, the exemplary yarn tensioner 10 (or "pre-tensioner") comprises a base 21 which attaches to a mounting arm 22 of canister bracket 15, an adjustable (e.g., pivotable) pin rack 24, a fixed pin rack 26, and a fastener assembly 28. The adjustable pin rack 24 is carried by the base 21 and incorporates a first set of spaced apart parallel friction pins 31. The friction pins 31 extend between and are affixed at respective opposite ends to a distal lift tab 32 and a pivot block 34. The fixed pin rack 26 is carried by the base 21 and incorporates a second set of spaced apart parallel friction pins 35 residing alternately between the friction pins 31 of the adjustable pin rack 24. Opposite ends of friction pins 35 are affixed to base posts 37, 38 formed at a rounded nose end of the pin rack 26 and adjacent the pivot block 34 of pin rack 24. The running yarn Y1 travels across the yarn tensioner 10 by snaking over and under closely-spaced adjacent parallel friction pins 31, 35 of the adjustable pin rack 24 and the fixed pin rack 26.

Figure 5:
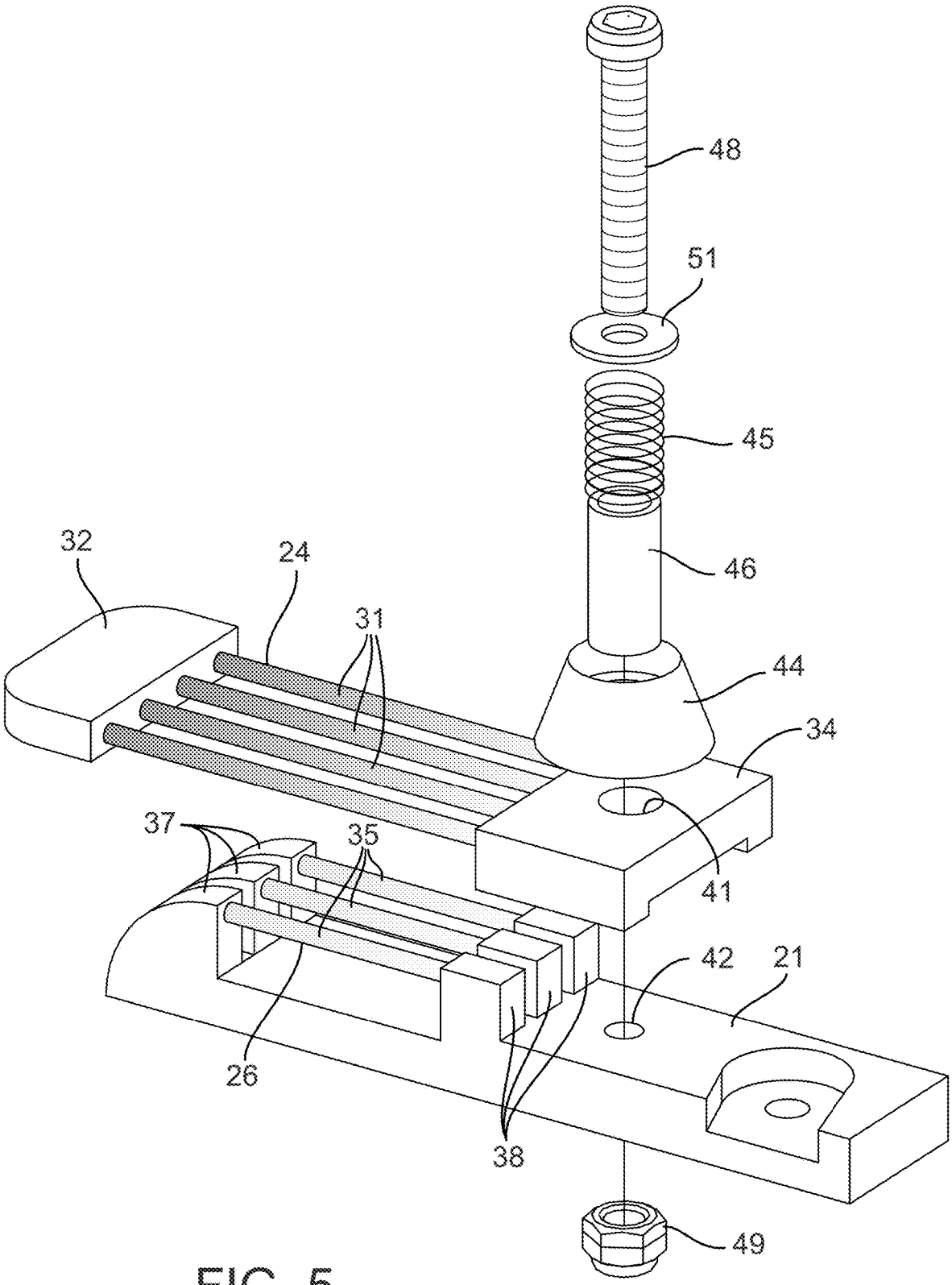
FIG. 5 is an exploded perspective view of the exemplary yarn tensioner.
Figure 6A:
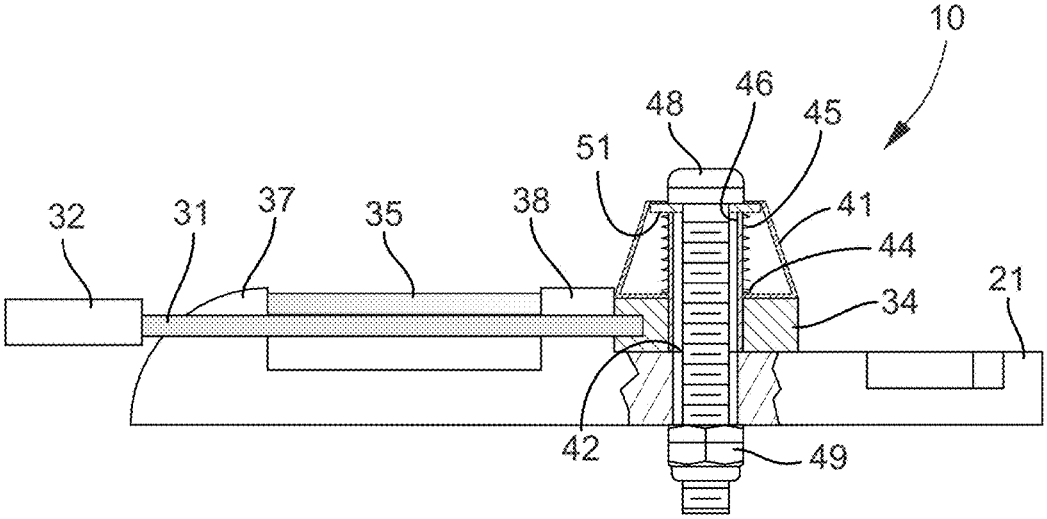
FIGS. 6A and 6B are side views of the exemplary yarn tensioner with portions shown in cross-section.
Figure 6B:
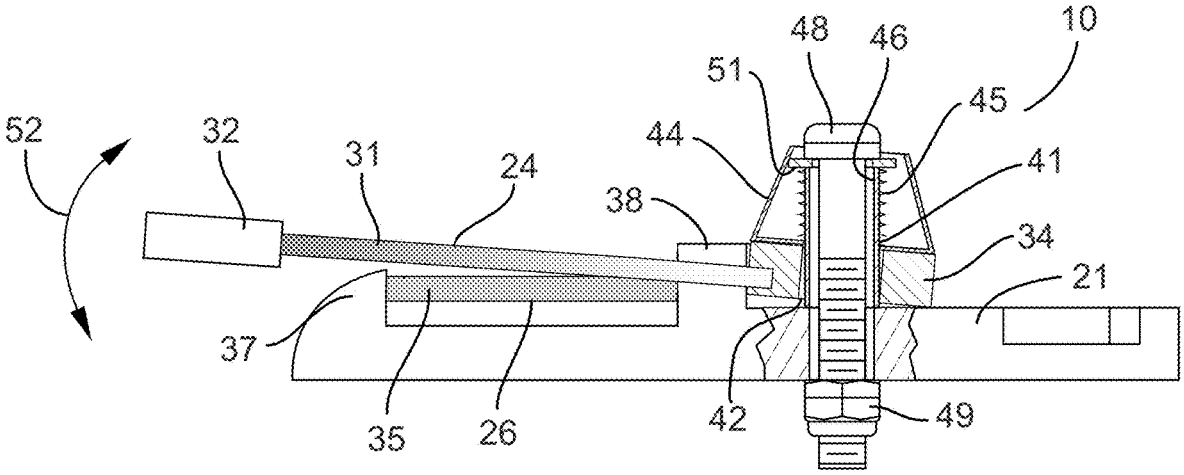
Figure 7:
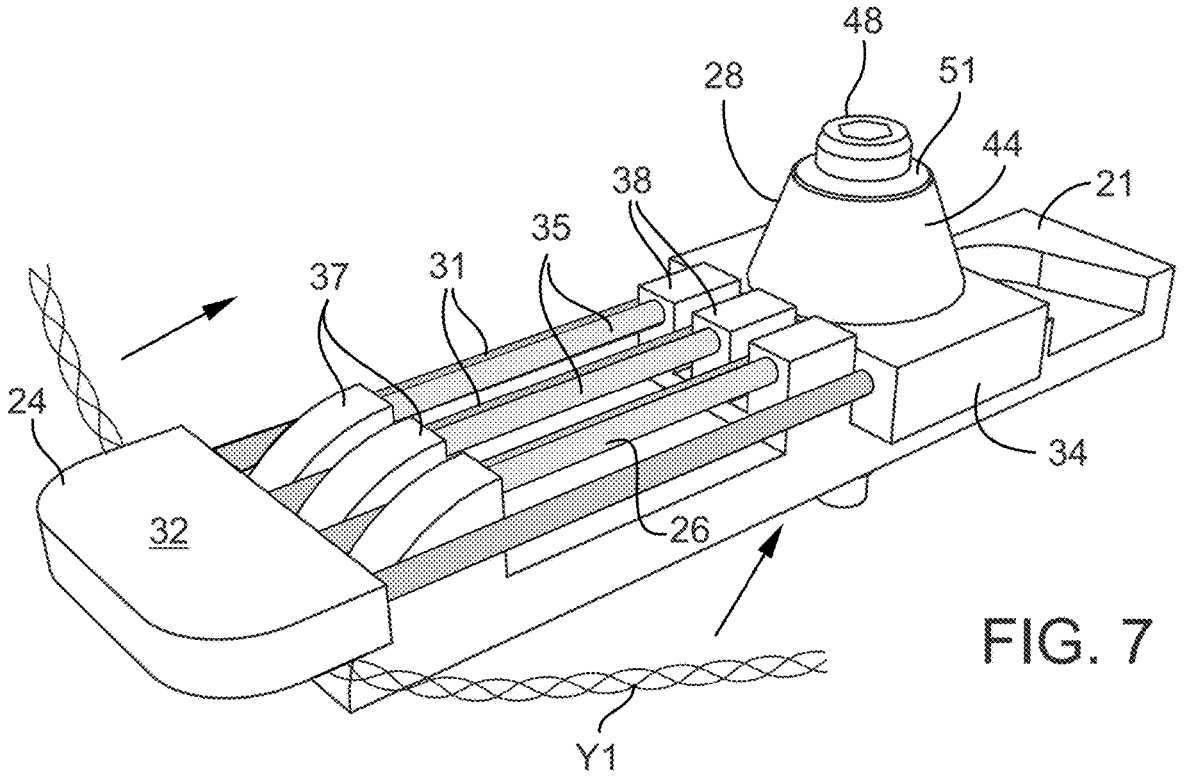
FIGS. 7, 8, and 9 are perspective views demonstrating sequential movement of the adjustable pin rack when threading the yarn tensioner.
Figure 8:
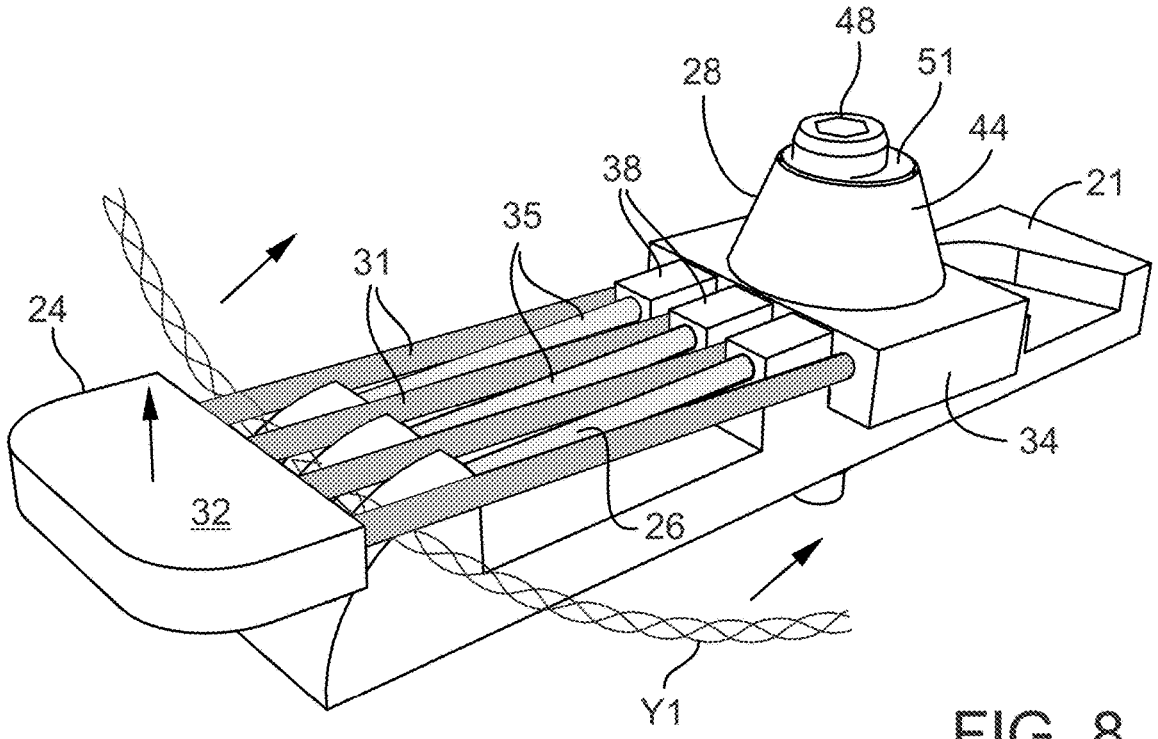
Figure 9:
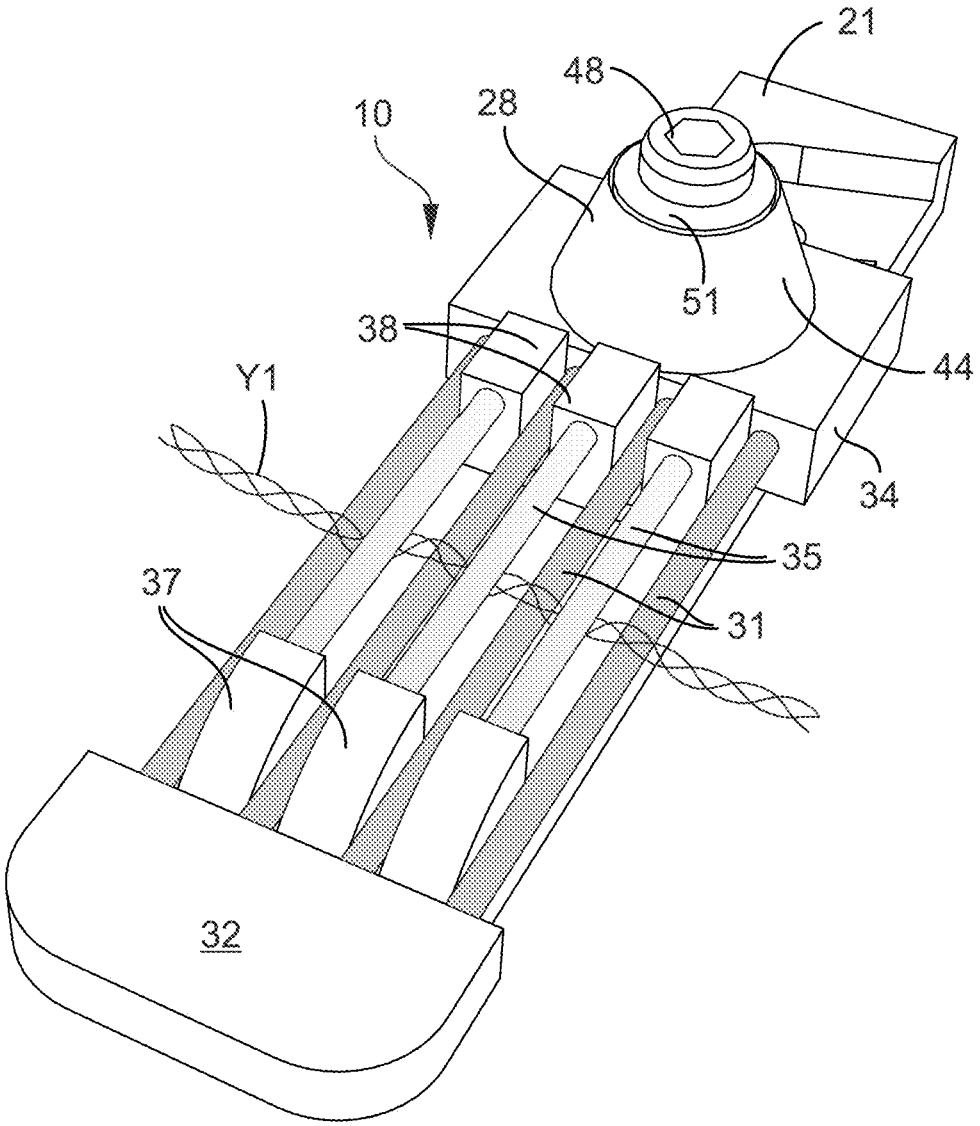

As best shown in FIGS. 5, 6A, and 6B, the pivot block 34 of adjustable pin rack 24 and the base 21 define substantially aligned block and base openings 41 and 42. The exemplary fastener assembly 28 comprises a generally cone-shaped upper spring housing 44 adjacent the block opening 41, a coiled spring 45 located within the upper spring housing 44, an interior spacer sleeve 46 extending within the spring 45, and an assembly bolt 48. The assembly bolt 48 extends through the spacer sleeve 46, the block opening 41, and the base opening 42, and has a threaded end which fastens to complementary-threaded lock nut 49 on a bottom side of the base 21. When threaded through the lock nut 49, the assembly bolt 48 cooperates with flat washer 51 and spring 45 to maintain the adjustable pin rack 24 in a spring-biased condition adjacent the base 21. As best shown in FIGS. 6A and 6B, the block opening 41 is larger than the base opening 42, such that the adjustable pin rack 24 is capable of upward pivoting movement (as indicated by arrow 52) from the planar spring-biased condition adjacent the fixed pin rack 26. The adjustable pin rack 24 is slightly pivotable at the assembly bolt 48, and can be lifted (manually at lift tab 32 or otherwise) against the normal biasing force of the spring 45. This enables convenient threading of the yarn tensioner 10 as demonstrated in FIGS. 7, 8, and 9. In an alternative embodiment, the biasing force generated by the spring 45 may be increased or decreased by tightening or loosening the assembly bolt 48, thereby controlling frictional drag on the running yarn Y1.

Exemplary Yarn Tensioner 100

Referring to FIGS. 10-13, the exemplary yarn tensioner 100 is carried by a creel bracket 101 mounted to the creel and comprising spaced apart yarn guides 102, 103. The yarn tensioner 100 is located between the yarn guides 102, 103 and functions to adjust tension in the running yarn Y2 drawn from the creel package 12A.

Like tensioner 10 described above, the yarn tensioner 100 comprises a base 111, an adjustable pin rack 112, a fixed pin rack 114, and a fastener assembly 115. The exemplary base 111 comprises a separate base plate 118 and a notched base extension 119. The adjustable pin rack 112 is carried by the base plate 118 and incorporates a first set of spaced apart parallel friction pins 121. The friction pins 121 extend between and are affixed at respective opposite ends to a distal lift tab 122 and a pivot block 124. The fixed pin rack 114 is also carried by the base 111 and incorporates a second set of spaced apart parallel friction pins 126 residing alternately between the friction pins 121 of the adjustable pin rack 112. Opposite ends of friction pins 126 are affixed to base posts 127, 128 located at a rounded nose end of the pin rack 114 and adjacent the pivot block 124 of pin rack 112. The running yarn Y2 travels across the yarn tensioner 100 by snaking over and under closely-spaced adjacent parallel friction pins 121, 126 of the adjustable pin rack 112 and the fixed pin rack 114.

Figure 14:
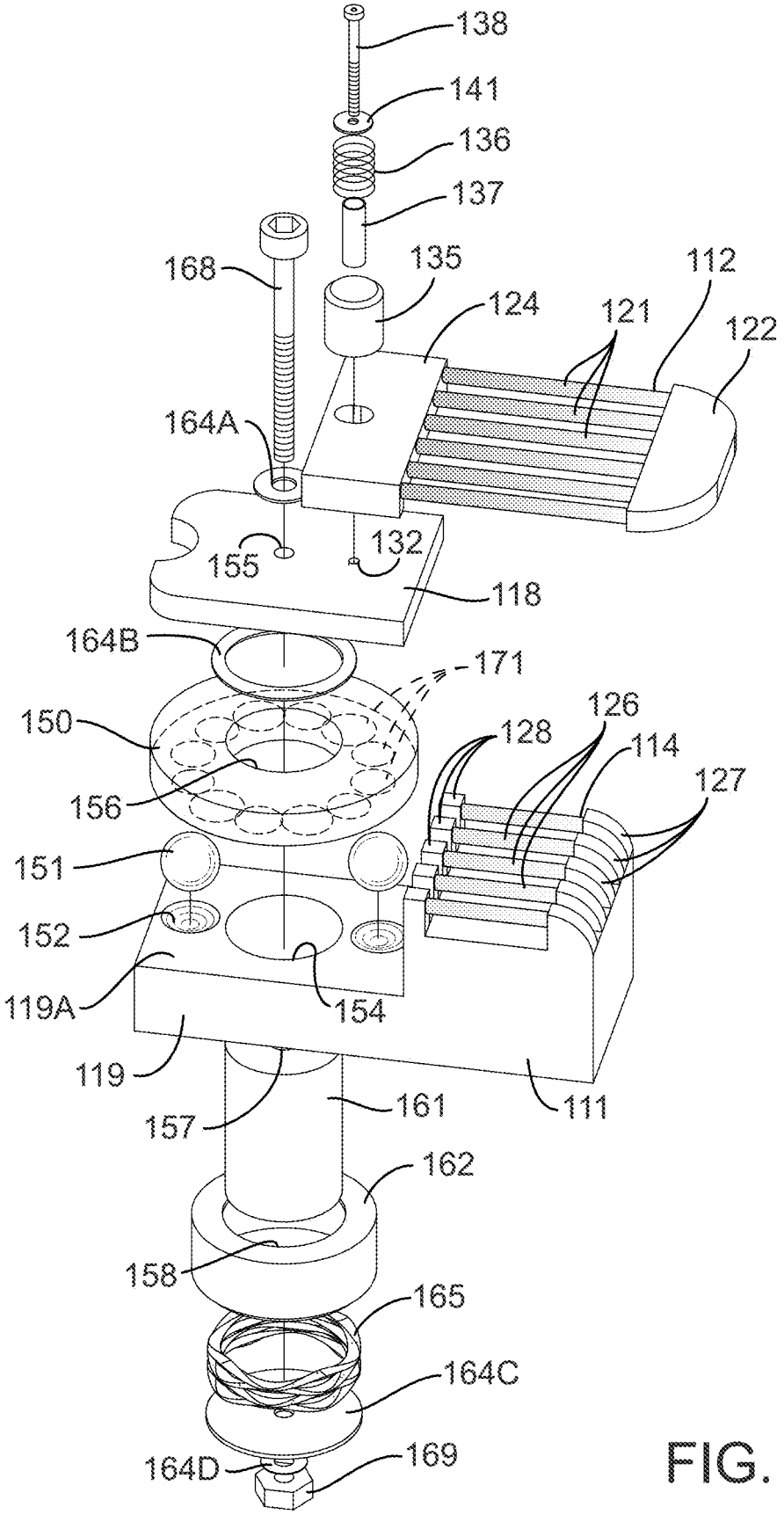
FIG. 14 is an exploded perspective view of the exemplary yarn tensioner.
Figure 15:
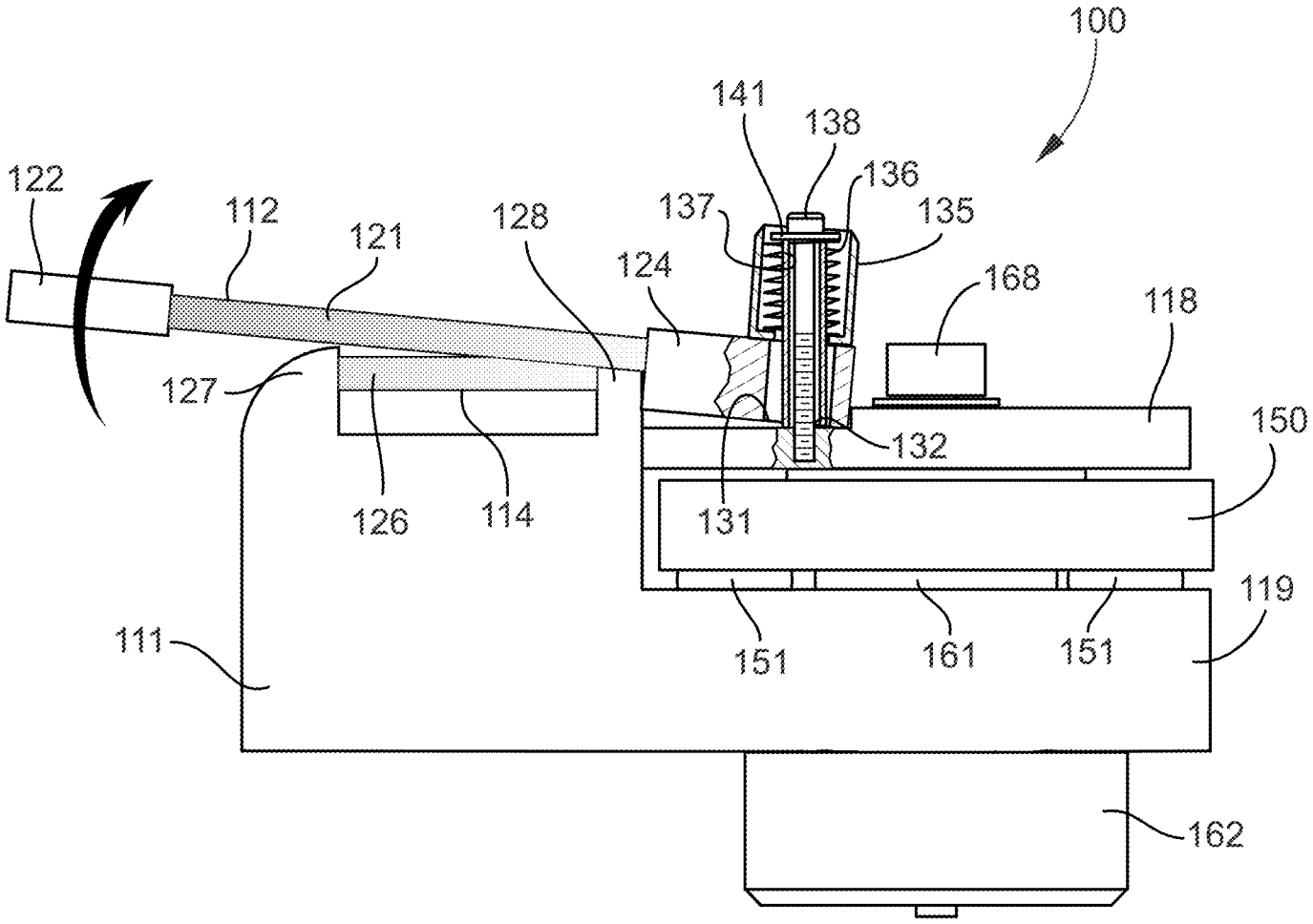
FIG. 15 is a side view of the exemplary yarn tensioner with a portion shown in cross-section.
Figure 16:
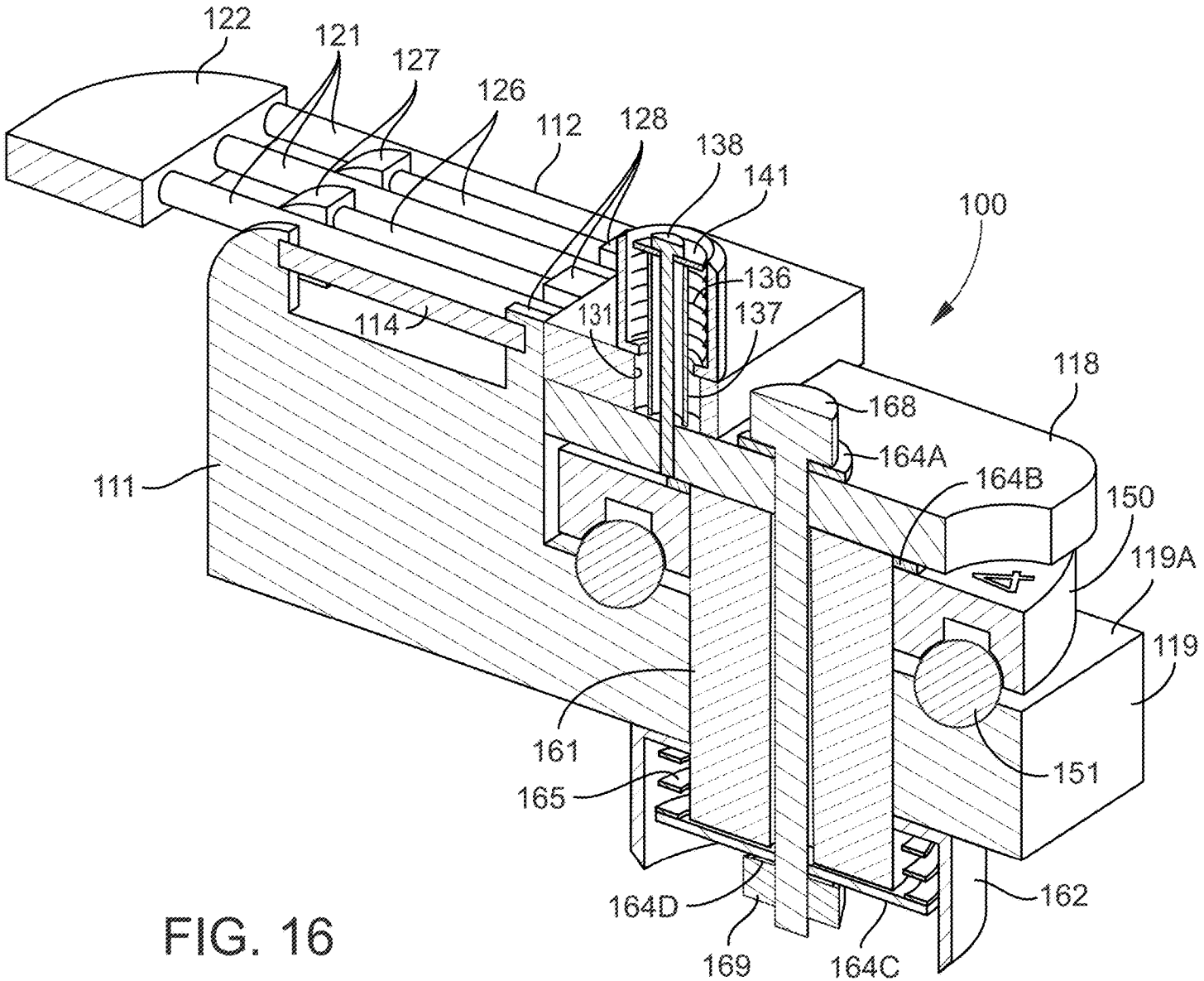
FIG. 16 is a further perspective view of the exemplary yarn tensioner shown in cross-section.

As best shown in FIGS. 14, 15, and 16, the pivot block 124 of adjustable pin rack 112 and the base plate 118 define substantially aligned block and base openings 131, 132. The exemplary fastener assembly 115 comprises a cylindrical upper spring housing 135 adjacent the block opening 131, a coiled spring 136 located within the upper spring housing 135, an interior spacer sleeve 137 extending within the spring 136, and an assembly bolt 138. The assembly bolt 138 extends through the spacer sleeve 137 and the block opening 131, and has a threaded end which fastens to a complementary internal screw thread formed with the base opening 132. When operatively screwed into the base opening 132, the assembly bolt 138 cooperates with a flat washer 141 and spring 136 to maintain the adjustable pin rack 112 in a spring-biased planar condition adjacent the fixed pin rack 114. As best shown in FIGS. 14 and 15, the block opening 131 is larger than the base opening 132, such that the adjustable pin rack 112 is capable of upward pivoting movement from its normally planar spring-biased condition. The adjustable pin rack 112 is slightly pivotable at the assembly bolt 138 and can be lifted (manually using lift tab 122 or otherwise), as indicated by direction arrow of FIG. 15, against the biasing force of the spring 136. This enables convenient threading of the yarn tensioner 100, as previously described. The biasing force generated by the spring 136 can be slightly increased or decreased by tightening or loosening the threaded assembly bolt 138, thereby controlling frictional drag on the running yarn Y2.

Referring to FIGS. 12, 13, 14 and 16, a rotatable tension adjustment wheel 150 resides between the base plate 118 and a top bearing surface 119A of the base extension 119. A pair of identical steel ball bearings 151, best shown in FIG. 14, are located on the top bearing surface 119A and directly engage an underside of the tension adjustment wheel 150. The ball bearings 151 are held within respective identical annular indents 152 on opposite sides of an extension hole 154 formed through the base extension 119. The extension hole 154 vertically aligns with holes 155, 156, 157, and 158 formed respectively in the base plate 118, the tension adjustment wheel 150, a barrel spacer 161, a cylindrical lower spring housing 162, and through flat washers 164A, 164B, 164C and 164D and a coiled spring 165. A second threaded assembly bolt 168 extends through the vertically aligned holes 154-158 and through washers 164A-164D, and fastens to a complementary-threaded locking nut 169 inside the lower spring housing 162. When tightened, the threaded assembly bolt 168 urges the flat washer 164C against the coiled spring 165 inside the lower housing 162. This compresses the spring 165 causing the tension adjustment wheel 150 to closely and firmly engage the two ball bearings 151 in a spring-biased condition.

Figure 17:
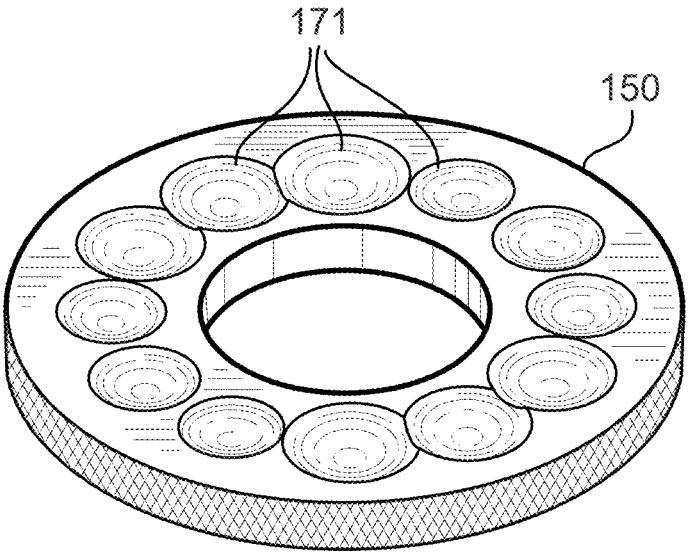
Figure 18:
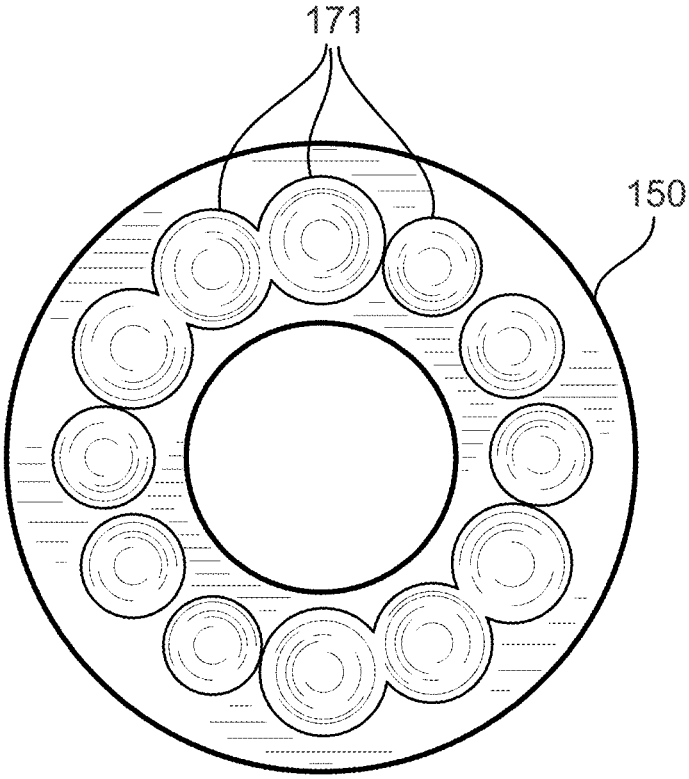

As best shown in FIGS. 16-18, 19 and 20, an underside of the tension adjustment wheel 150 defines a plurality of circumferentially arranged, individual, annular bearing races 171. As indicated above, the tension adjustment wheel 150 is sandwiched between the base plate 118 and ball bearings 151, and the base plate 118 is attached directly to the pivot block 124 of adjustable pin rack 112 by the first assembly bolt 138. The underside of tension adjustment wheel 150 is shown in FIGS. 17, 18 and 19. The bearing races 171 located at opposite ends of respective diameter lines A, B, C, D, E, and F (See FIG. 19) comprise a set having an identical depth, and are intended to align with the two ball bearings 151 to temporarily secure the adjustable pin rack 112 at a desired planar depth relative to the fixed pin rack 114.

Figure 21:
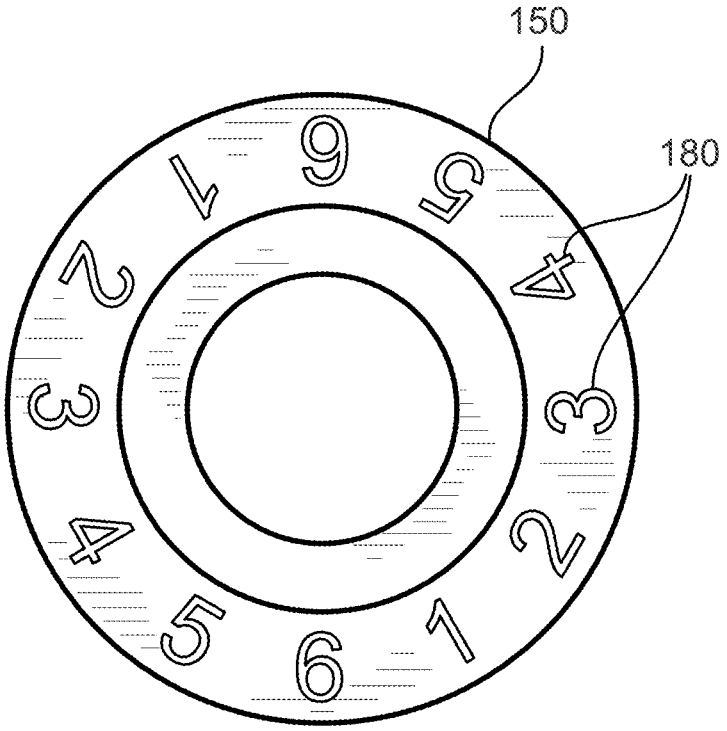
FIG. 21 is a topside view of the exemplary tension adjustment wheel.
Figure 22A:
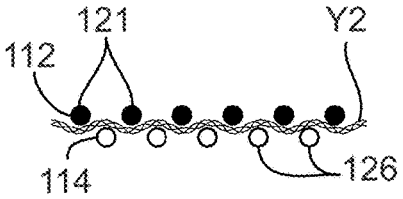
FIGS. 22A-22C are views illustrating an uppermost planar position of the adjustable pin rack, an intermediate planar position of the adjustable pin rack, and lowermost planar position of the adjustable pin rack.
Figure 22A:
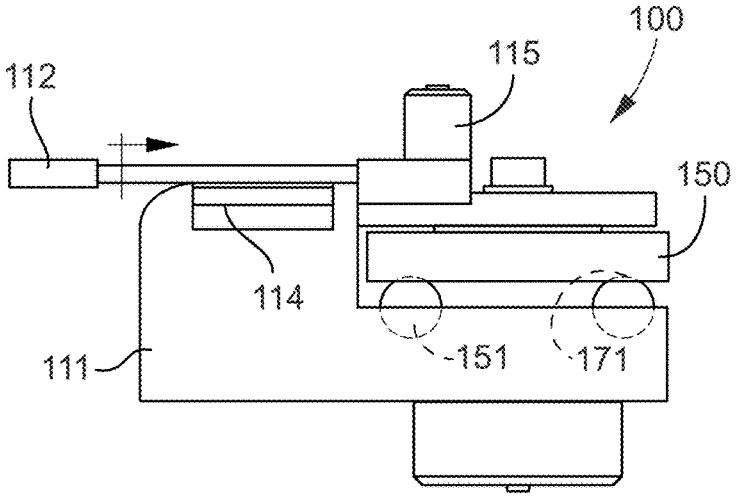
Figure 22B:
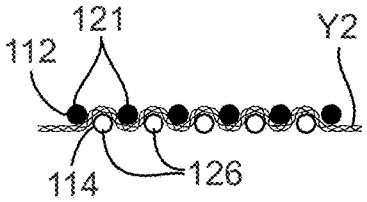
Figure 22B:
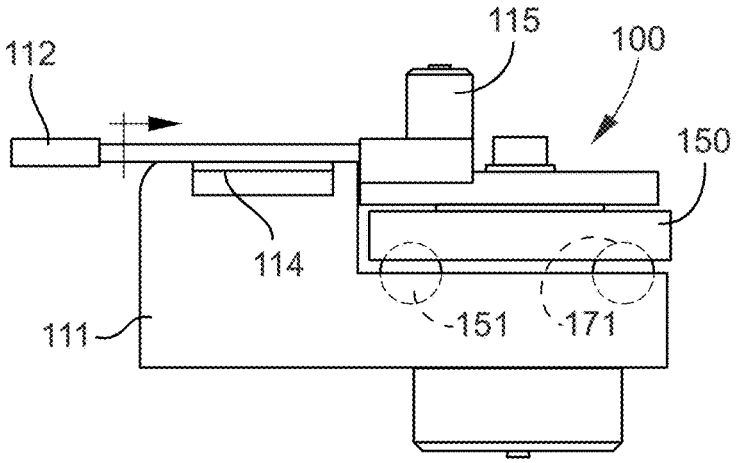
Figure 22C:
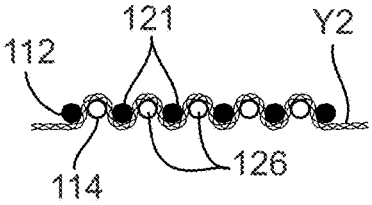
Figure 22C:
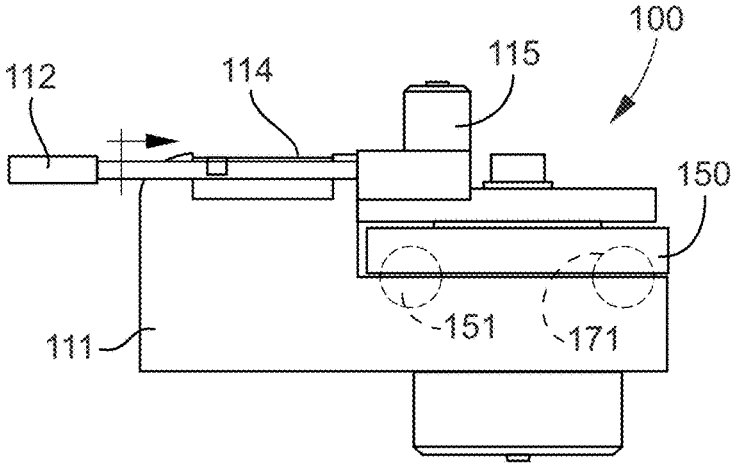

Referring to FIGS. 19 and 20A-20F, the exemplary tension adjustment wheel 150 has 6 different sets of bearing races 171 corresponding to 6 different planar depth settings of the adjustable pin rack 112 relative to the fixed pin rack 114. Manually rotating the tension adjustment wheel 150 positions the two ball bearings 151 in a selected set of bearing races 171 of a particular depth. Locating the two ball bearings 151 in a set of relatively deep bearing races 171 (e.g., FIGS. 20A and 20F) moves the adjustable pin rack 112 to a lowered planar position relative to the fixed pin rack 114, thereby increasing tension in the running yarn Y2 traveling across the yarn tensioner 100. Locating the two ball bearings 151 in a set of the relatively shallow bearing races 171 (e.g., FIGS. 20C and 20E) moves the adjustable pin rack 112 to a raised planar position relative to the fixed pin rack 114, thereby reducing tension in the running yarn Y2 traveling across the yarn tensioner 100. The tension adjustment wheel 150 may also comprise tension setting indicia 180 shown in FIG. 21. In one embodiment, the exemplary tensioner 100 includes available settings within a graduated tension range of approximately 0 grams to 300 grams, and up to 2000 grams. FIGS. 22A-22C show the adjustable pin rack 112 located in an uppermost planar position relative to the fixed pin rack 114, an intermediate planar position relative to the fixed pin rack 114, and a lowermost planar position relative to the fixed pin rack 114.

Either of the exemplary yarn tensioners 10 and 100 described above may be used inside the canister or may be mounted on the creel, and either may be used alone or in combination with other yarn tensioners or pre-tensioners, and either may be used in any other application requiring any degree of yarn tensioning in a textile machine.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A yarn tensioner adapted for adjusting tension in a running yarn, said yarn tensioner comprising:

a base;

an adjustable pin rack carried by said base and comprising a first plurality of spaced apart parallel friction pins;

a fixed pin rack carried by said base and comprising a second plurality of spaced apart parallel friction pins residing alternately between said friction pins of said adjustable pin rack, whereby the running yarn travels across said yarn tensioner by snaking over and under adjacent parallel friction pins of said adjustable pin rack and said fixed pin rack; and a fastener assembly attaching said adjustable pin rack to said base, such that said adjustable pin rack is movable relative to said fixed pin rack, thereby controlling frictional drag on the running yarn, and wherein said adjustable pin rack has opposing distal and proximal ends, and a lift tab located at said distal end adjacent a rounded nose of said fixed pin rack.

2. The yarn tensioner according to claim 1, and comprising a pivot block located at said proximal end of said adjustable pin rack.

3. The yarn tensioner according to claim 2, wherein said pivot block and said base define substantially aligned block and base openings, and wherein said fastener assembly comprises an upper spring housing adjacent said block opening, a coiled spring located within said upper spring housing, an interior spacer sleeve extending within said spring, and an assembly bolt extending through said spacer sleeve, said block opening, and said base opening, whereby said assembly bolt cooperates with said spring to maintain said adjustable pin rack in a spring-biased condition adjacent said base.

4. The yarn tensioner according to claim 3, wherein said block opening is larger than said base opening, such that said adjustable pin rack is capable of upward pivoting movement from the spring-biased condition adjacent said base.

5. The yarn tensioner according to claim 4, wherein said base comprises a notched base extension and a base plate adjacent said base extension, and wherein said assembly bolt attaches said pivot block to said base plate such that upward and downward planar movement of said base plate relative to said base extension effects corresponding upward and downward planar movement of said adjustable pin rack relative to said fixed pin rack.

6. The yarn tensioner according to claim 5, and comprising a rotatable tension adjustment wheel residing between said base plate and a top bearing surface of said base extension.

7. The yarn tensioner according to claim 6, and comprising at least one ball bearing residing between said tension adjustment wheel and the top bearing surface of said base extension.

8. The yarn tensioner according to claim 7, wherein an underside of said tension adjustment wheel defines a plurality of circumferentially arranged annular bearing races.

9. The yarn tensioner according to claim 8, and comprising a second assembly bolt extending through aligned openings formed in said base plate, said tension adjustment wheel, and said base extension.

10. The yarn tensioner according to claim 9, and comprising a barrel spacer surrounding said second assembly bolt.

11. The yarn tensioner according to claim 10, and comprising a lower spring housing adjacent a bottom side of said base extension, and comprising a spring located within said lower spring housing and cooperating with said second assembly bolt to maintain said tension adjustment wheel in a spring-biased condition relative to said at least one ball bearing and said bearing surface of said base extension.

12. The yarn tensioner according to claim 11, wherein adjacent ones of said bearing races are formed at different depths, such that rotation of said tension adjustment wheel locates said at least one ball bearing in a selected bearing race of a particular depth, whereby:

relatively deep bearing races move said adjustable pin rack to a lowered position relative to said fixed pin rack, thereby increasing tension in the running yarn traveling across said yarn tensioner; and relatively shallow bearing races move said adjustable pin rack to a raised position relative to said fixed pin rack, thereby reducing tension in the running yarn traveling across said yarn tensioner.

13. The yarn tensioner according to claim 12, wherein said tension wheel comprises tension setting indicia.

14. A yarn supply canister for use in a direct-cabling textile machine, said supply canister comprising:

a canister housing designed for holding a yarn supply package upstream of the textile machine;

a yarn guide located inside said canister housing for receiving running yarn pulled from the supply package at an unwinding tension;

a yarn tensioner downstream of said yarn guide for adjusting unwinding tension in the running such that yarn exits said canister housing at an adjusted delivery tension, said yarn tensioner comprising:

a base;

an adjustable pin rack carried by said base and comprising a first plurality of spaced apart parallel friction pins;

a fixed pin rack carried by said base and comprising a second plurality of spaced apart parallel friction pins residing alternately between said friction pins of said adjustable pin rack, whereby the running yarn travels across said yarn tensioner by snaking over and under adjacent parallel friction pins of said adjustable pin rack and said fixed pin rack; and a fastener assembly attaching said adjustable pin rack to said base, such that said adjustable pin rack is movable relative to said fixed pin rack, thereby controlling frictional drag on the running yarn, and wherein said adjustable pin rack has opposing distal and proximal ends, and a lift tab located at said distal end adjacent a rounded nose of said fixed pin rack.

15. The yarn tensioner according to claim 14, and comprising a pivot block located at said proximal end of said adjustable pin rack.

16. The yarn tensioner according to claim 15, wherein said pivot block and said base define substantially aligned block and base openings, and wherein said fastener assembly comprises an upper spring housing adjacent said block opening, a coiled spring located within said upper spring housing, an interior spacer sleeve extending within said spring, and an assembly bolt extending through said spacer sleeve, said block opening, and said base opening, whereby said assembly bolt cooperates with said spring to maintain said adjustable pin rack in a spring-biased condition adjacent said base.

17. The yarn tensioner according to claim 16, wherein said block opening is larger than said base opening, such that said adjustable pin rack is capable of upward pivoting movement from the spring-biased condition adjacent said base.

18. A method for adjusting tension in a running yarn, said method comprising:

drawing the running yarn alternatively over and under adjacent parallel friction pins of an adjustable pin rack and a fixed pin rack;

enabling pivoting movement of the adjustable pin rack relative to the fixed pin rack, such that a distal end of the adjustable pin rack is capable of lifting upwardly at a rounded nose of the fixed pin rack; and enabling planar upward and downward adjustment of the adjustable pin rack relative to the fixed pin rack, such that:

a lowered position of the adjustable pin rack relative to the fixed pin rack increases tension in the running yarn; and a raised position of the adjustable pin rack relative to the fixed pin rack reduces tension in the running yarn.

* * * * *